US009883753B2

(12) United States Patent
Saladyga

(10) Patent No.: US 9,883,753 B2
(45) Date of Patent: Feb. 6, 2018

(54) EXPANDABLE RETAIL SHELF TRAY

(71) Applicant: Sonoco Development, Inc., Hartsville, SC (US)

(72) Inventor: Kevin Saladyga, Winston-Salem, NC (US)

(73) Assignee: Sonoco Development, Inc., Hartsville, SC (US)

( * ) Notice: Subject to any disclaimer, the term of this patent is extended or adjusted under 35 U.S.C. 154(b) by 76 days.

(21) Appl. No.: 15/184,218

(22) Filed: Jun. 16, 2016

(65) Prior Publication Data

US 2017/0360222 A1 Dec. 21, 2017

(51) Int. Cl.

| | |
|---|---|
| ***A47F 5/00*** | (2006.01) |
| ***B65D 25/00*** | (2006.01) |
| ***B65D 5/30*** | (2006.01) |
| ***B65D 5/00*** | (2006.01) |
| ***B65D 5/22*** | (2006.01) |

(52) U.S. Cl.

CPC ..... *A47F 5/0025* (2013.01); *B65D 5/009* (2013.01); *B65D 5/22* (2013.01); *B65D 5/302* (2013.01); *B65D 25/005* (2013.01)

(58) Field of Classification Search

CPC ..... A47F 5/0025; B65D 5/22; B65D 5/302; B65D 25/005; B65D 5/009

USPC ..... 206/757, 736, 739, 745, 747, 744, 755

See application file for complete search history.

(56) References Cited

U.S. PATENT DOCUMENTS

| | | | | |
|---|---|---|---|---|
| 3,231,077 | A * | 1/1966 | Grimm | B65D 5/4204 229/112 |
| 5,007,580 | A * | 4/1991 | Morrison | B65D 5/18 229/117.17 |
| 6,948,616 | B2 * | 9/2005 | Gillani | B65D 5/4216 206/459.5 |
| 7,784,617 | B2 * | 8/2010 | Urban | B65D 5/2038 206/45.25 |
| 8,292,095 | B2 * | 10/2012 | Howlett | A47F 5/112 211/126.16 |
| 2008/0034632 | A1 * | 2/2008 | Urban | G09F 1/06 40/610 |
| 2009/0178988 | A1 | 7/2009 | Lang | |

* cited by examiner

*Primary Examiner* — Chun Cheung

(74) *Attorney, Agent, or Firm* — Miller, Matthias & Hull LLP

(57) ABSTRACT

A product shipping and display tray made from a unitary blank is provided. The tray comprises one and preferably two expandable side panel assemblies to take up additional shelf space if desired. Each side panel assembly comprises an intermediate side panel extending forward from a rear panel, an inner side panel in flat, abutting relationship to the inner facing surface of the intermediate side panel, and an outer side panel rotatably attached to the inner side panel along a front vertical edge. Each outer side panel is moveable between a first position in which the outer side panel is in a flat, abutting relationship to the intermediate side panel and a second position in which the outer side panel is rotated outwardly away from the intermediate side panel.

16 Claims, 8 Drawing Sheets

EXPANDABLE RETAIL SHELF TRAY

BACKGROUND

Field of the Invention

This patent relates to a retail product shipping and display tray. More particularly, this patent relates to a retail product shipping and display tray that can expand laterally.

Description of the Related Art

Shipping trays that double as retail display trays can be time and labor saving for the retailer. However, retailers sometimes need or want to fill shelves of varying widths with the same display tray, but the display trays usually come in a single width. A display tray is needed that can be expanded to take up additional, excess lateral shelf space.

SUMMARY OF THE INVENTION

The present invention is a shipping and display tray that can be expanded to take up additional, excess lateral shelf space. The tray may be made from a unitary blank that has been cut and provided with fold lines and tabs so that the tray may be assembled without tools or adhesives.

In one embodiment the tray comprises a bottom panel, a front panel assembly, a rear panel assembly and at least one side panel assembly. The bottom panel extends laterally from one side edge to an opposite side edge and rearwardly from a front fold line to a rear fold line. The front panel assembly is hingedly attached to the bottom panel along the front fold line and extends upwardly from the bottom panel. The rear panel assembly is hingedly attached to the bottom panel along a rear fold line and extends upwardly from the bottom panel. The side panel assembly comprises an intermediate side panel interposed between an inner side panel and an outer side panel. The intermediate side panel is attached orthogonally to the rear panel assembly along a side fold line. The inner side panel is attached to the intermediate side panel along a fold line. The outer side panel is hingedly attached to the inner side panel along a rotational fold line. The tray may further comprise a top panel hingedly attached to each outer side panel along a top fold line, with the top panel oriented perpendicularly to the outer side panel and parallel to the bottom panel.

In a key aspect of the tray, the outer side panel is moveable between a first, unexpanded position in which the outer side panel is in a flat, abutting relationship with the intermediate side panel and a second, expanded position in which the outer side panel rotated outwardly away from the inner side panel and the intermediate side panel. In the expanded position that outer side panel forms an angle of rotation ($\beta$) with the intermediate side panel.

The front panel assembly may comprise an outer front panel hingedly attached to the bottom panel along a front fold line and an inner front panel attached to the outer front panel along a double fold line and affixed to the bottom panel.

The bottom panel may be reinforced with a second bottom layer comprising two partial bottom panels. Each partial bottom panel may be foldably connected to an intermediate side panel along a fold line and may extend inwardly from the fold line.

The rear panel assembly may comprise an outer rear panel and an inner rear panel hingedly attached to the outer rear panel along a double fold line and attached to the bottom panel.

A locking panel may be hingedly connected to the outer side panel along a fold line, and may be configured to fit between the partial bottom panel and the bottom panel when the tray is in the first, unexpanded position.

The locking panel may be substantially triangular and may have a first free edge that forms a locking panel angle ($\alpha$) with the fold line. The locking panel angle ($\alpha$) may be the same as the angle of rotation ($\beta$).

The intermediate side panel may define a locking opening into which a locking tab may be inserted. The locking tab may extend from the free edge of the locking panel, and is configured to fit into the locking opening to lock the outer side panel in place when the outer side panel is in the second, expanded position.

In another aspect, the disclosure relates to a single, unitary blank for making a laterally expandable tray. The blank may comprise a number of major panels, including bottom panel, an outer front panel, an inner front panel, an outer rear panel, an inner rear panel, two intermediate side panels, two inner side panels, two outer side panels and two top panels. The bottom panel may extend laterally from a side cut line to an opposite side cut line and rearwardly from a front fold line to a rear fold line. The outer front panel may be connected to the bottom panel along the front fold line. The inner front panel may be connected to the outer front panel along a double fold line. The outer rear panel may be connected to the bottom panel along the rear fold line and may extend laterally from a side fold line to an opposite side fold line. The inner rear panel may be connected to the outer rear panel along a rear double fold line, and may extends laterally from a side cut line to an opposite side cut line. Each intermediate side panel may be connected to an outer rear panel by a fold line. Each inner side panel may be connected to an intermediate side panel along a fold line. Each outer side panel may be connected to an inner side panel along a fold line. Each top panel may be connected to an outer side panel along a fold line.

The blank may further comprise two rear edge panels, each rear edge panel connected to an outer side panel along a fold line.

The blank may further comprise two partial bottom panels, each partial bottom panel connected to an intermediate side panel along a fold line.

The blank may further comprise two substantially triangular locking panels, each locking panel connected to an outer side panel along a fold line.

THE DRAWINGS

FIG. 4 is a perspective view of the blank of FIG. 3 shown partially folded to create a partially assembled tray.

FIG. 5 is a perspective view of the partially assembled tray of FIG. 4 after further folding.

FIG. 6 is a perspective view of the partially assembled tray of FIG. 5 after further folding.

FIG. 7 is a perspective view of the partially assembled tray of FIG. 6 after further folding.

FIG. 8 is a perspective view of the partially assembled tray of FIG. 7 after further folding.

FIG. 9 is a perspective view of the partially assembled tray of FIG. 8 after further folding.

FIG. 10 is a perspective view of the partially assembled tray of FIG. 9 after further folding.

FIG. 11 is a perspective view of the partially assembled tray of FIG. 10 after further folding.

DETAILED DESCRIPTION OF THE INVENTION

Figure 1:
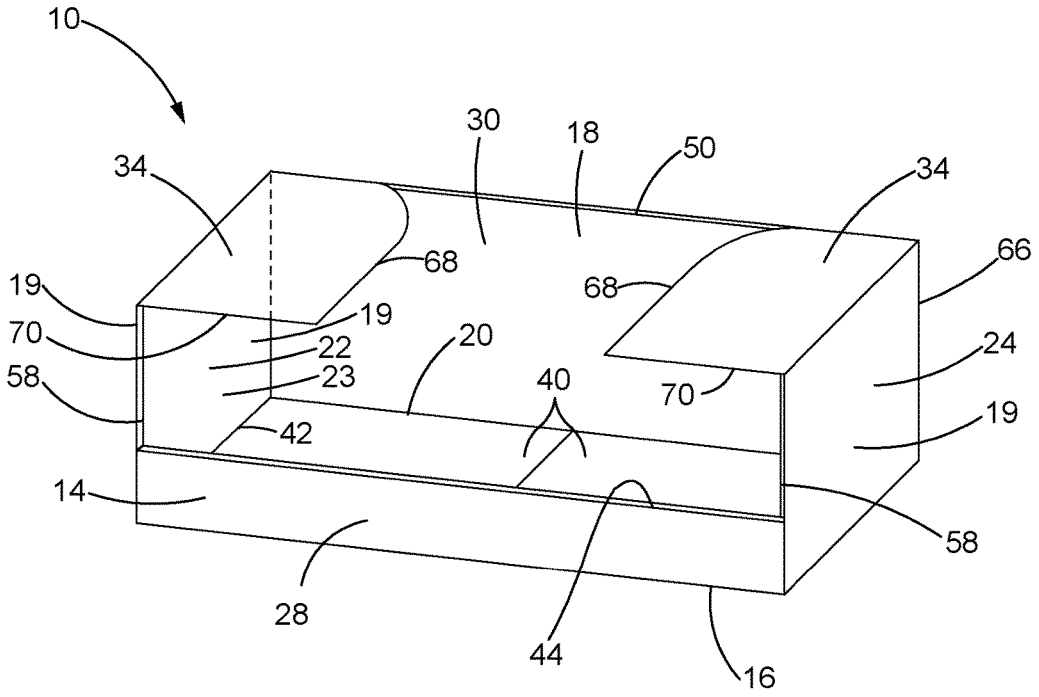
FIG. 1 is a perspective view of a product tray according to the disclosure, shown in a first, unexpanded, configuration.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments.

As will be appreciated, terms such as "above" and "below", "rearward", "outward", "horizontal," "left," "right," "up," "down," "top," "bottom," "front" and "back," and "inward" (etc.), used as nouns, adjectives or adverbs (e.g. "rearwardly", "outwardly", "horizontally", "laterally" etc.) generally refer in this description to the orientation of the structure of the tray 10 as it is illustrated in the front perspective views, such as FIGS. 1, 2 and 12. For example, "rearwardly" generally refers to the direction toward the rear of the tray and "upwardly" generally refers to the direction toward the top of the tray. Such terms are not intended to limit the invention to a particular orientation. Similarly, the terms "lateral" and "longitudinal" generally refer to the orientation of surfaces or other structures relative to an axis of elongation or axis of rotation, as appropriate.

Finally, like structures and features may be given the same element number in both the assembled tray and the tray blank.

The Expandable Product Tray

Turning to the drawings, FIG. 1 is a perspective view of an expandable product tray 10 according to the disclosure, shown in a first, unexpanded, configuration. The tray 10 is formed from a single blank 100 (FIG. 3) and comprises the following major components: a bottom panel 12 (obscured by the two partial bottom panels 40 in FIG. 1 and best shown in FIG. 3), a double thickness front panel assembly 14, a double thickness rear panel assembly 18, two triple thickness side panel assemblies 19 and two top panels 34.

The bottom panel 12 extends laterally (side to side) from one inner side panel 22 to the opposite inner side panel 22 and rearwardly (front to back) from the front panel assembly 14 to the rear panel assembly 18.

The double thickness front panel assembly 14 comprises an outer front panel 28 hingedly attached to the bottom panel 12 along a front fold line 16 and an inner front panel 26 hingedly attached to the outer front panel along a double fold lines 44. The inner front panel 26 is folded over the outer front panel 28 to provide the double thickness. The front panel assembly 14 is hingedly attached to the bottom panel 12 along the front fold line 16. The front panel assembly 14 preferably has a height substantially less than the height of the rear panel assembly 18 to better display products in the tray 10.

The double thickness rear panel assembly 18 comprises an outer rear panel 32 and an inner rear panel 30 and is hingedly attached to the bottom panel 12 along a rear fold line 20. The inner rear panel 30 is folded over the outer rear panel 32 to provide the double thickness. The rear panel assembly 18 is hingedly attached to the bottom panel 12 along a rear fold line 20.

Figure 13:
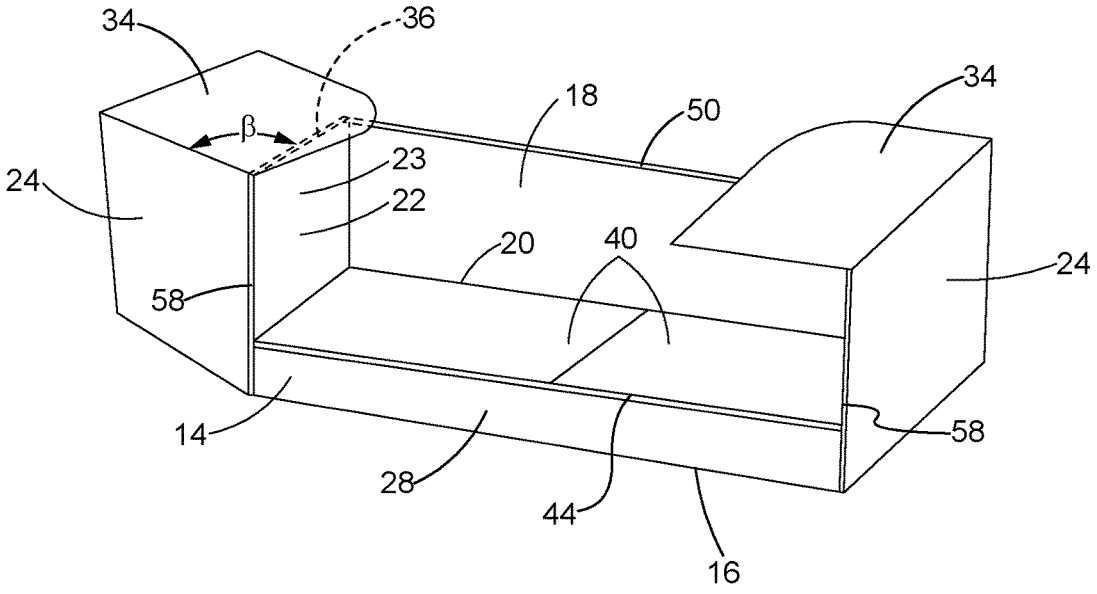
FIG. 13 is a perspective view of the tray of FIG. 12 after the left side has been expanded.
Figure 14:
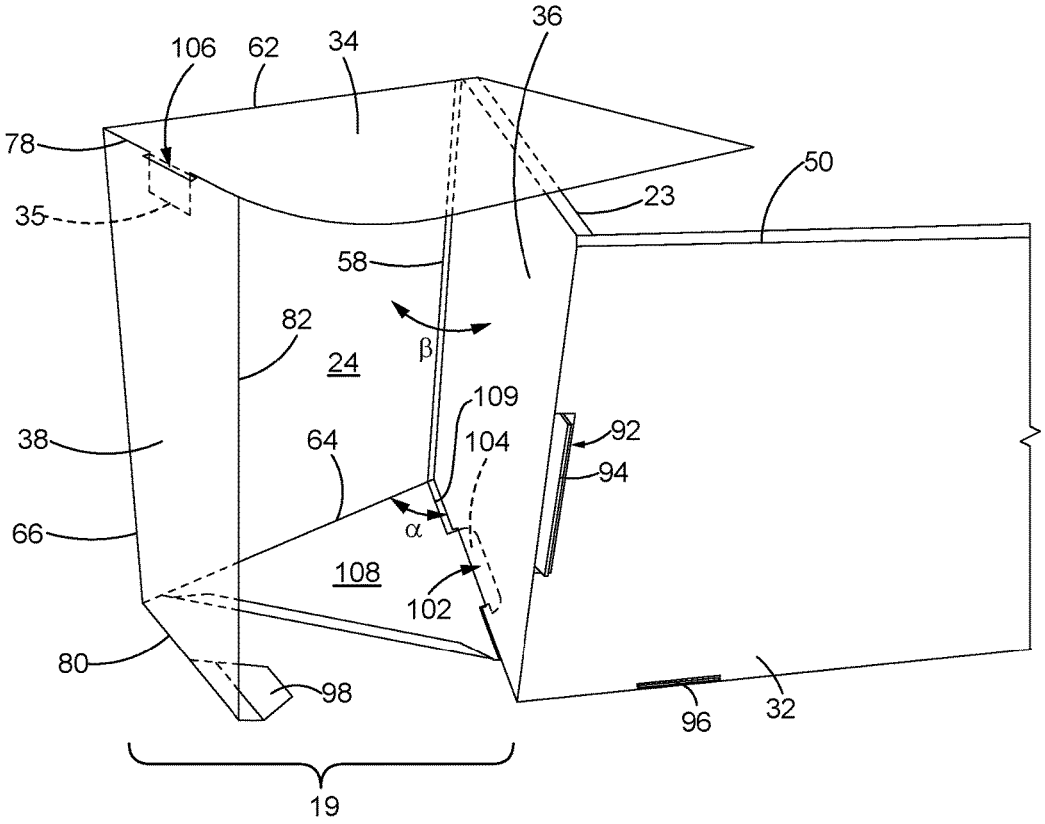
FIG. 14 is a partial rear perspective view of the tray of FIG. 12 showing the right side expanded.

Each triple thickness side panel assembly 19 comprises an intermediate side panel 36 sandwiched between an inner side panel 22 and an outer side panel 24. The intermediate side panel 36 is hingedly attached to the outer rear panel 32 along a fold line 74. Each outer side panel 24 is moveable between a first position in which the outer side panel 24 is perpendicular to the rear panel assembly 18 (FIGS. 1 and 12) and a second position in which the outer side panel 24 is rotated outwardly along a rotational fold line 58 (which functions as an axis of rotation) to increase the width of the tray (FIGS. 2, 13 and 14).

Each top panel 34 is hingedly attached to a corresponding side panel assembly 19 and, more particularly, to a corresponding outer side panel 24, by a top fold line 62. In the assembled tray 10 each top panel 34 is oriented perpendicular to the outer side panel 24 and parallel to the bottom panel 12 and provides partial covering for the products in the tray 10.

In summary, the tray 10 may be sued to hold and transport products for retail display. Once on the retail shelf, one or both outer side panels 24 may be pulled or rotated outwardly along front fold lines 58 to take up additional shelf space and to provide a more eye catching display.

Figure 2:
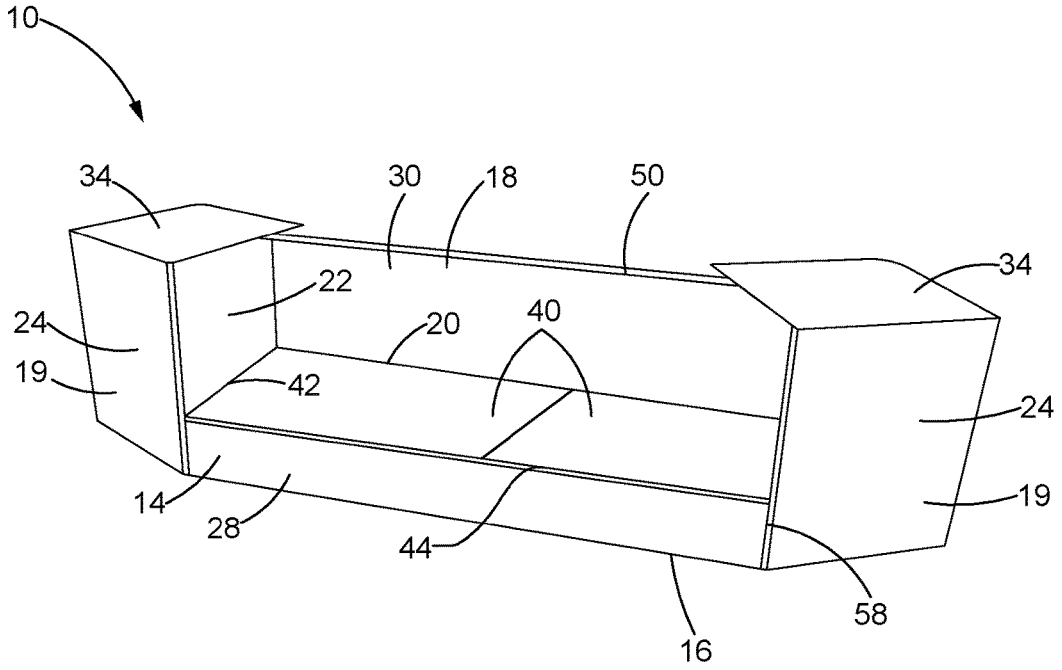
FIG. 2 is a perspective view of the product tray of FIG. 1 shown in a fully expanded configuration.

FIG. 2 is a perspective view of the product tray 10 of FIG. 1 shown in a fully expanded configuration. Both outer side panels 24 have been rotated outwardly along their respective front fold lines 58 to provide a fully expanded tray 10. The top panels 34 are connected to the outer side panels 24 and thus rotate along with the outer side panels 24. As described in more detail below with respect to FIG. 14, each locking tab 104 (obscured in FIG. 2) may be inserted through a locking opening 102 (also obscured) in the intermediate side panel 36 and a corresponding aligned opening 103 defined by the inner side panel 22 to engage an inner facing surface of the inner side panel 22 to hold the outer side panels 24 in the expanded position.

Tray Blank

Figure 3:
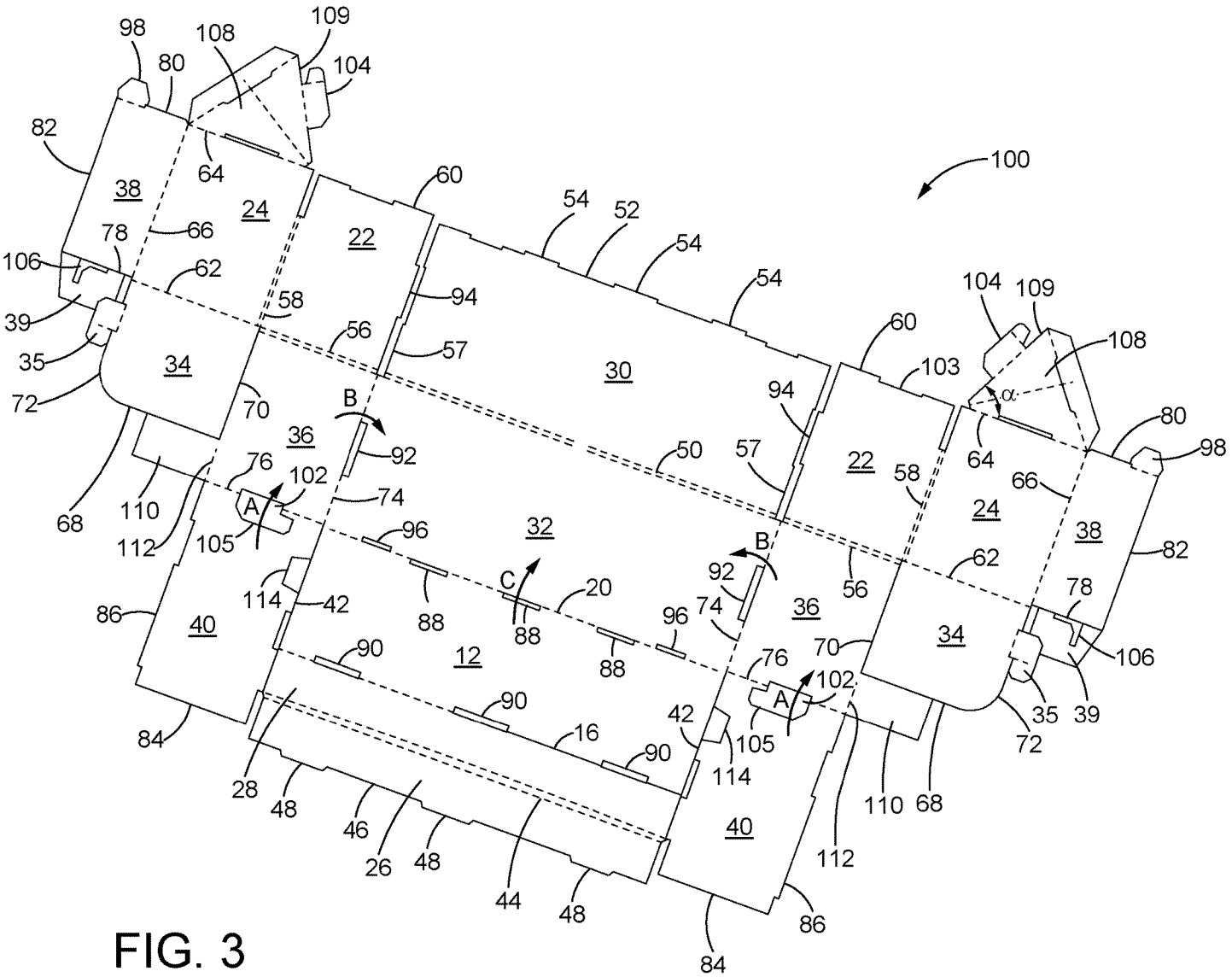
FIG. 3 is a perspective view of a blank used to make the tray of FIG. 1.

FIG. 3 is a perspective view of a blank 100 that may be used to make the tray 10 of FIGS. 1 and 2. The tray 10 may be constructed from a single piece, i.e. unitary, blank; there are no separate components required to facilitate the assembly or expansion process. Preferably the tray 10 is constructed from corrugated board, although any suitable material may be used.

The blank 100 comprises the following main panels: a bottom panel 12, an inner front panel 26, an outer front panel 28, an inner rear panel 30, an outer rear panel 32, two inner side panels 22, two outer side panels 24, two top panels 34, two intermediate side panels 36, two rear edge panels 38 and two partial bottom panels 40. The blank 100 may be symmetrical about a line running front to rear and bisecting the bottom panel 12.

The bottom panel 12 may be rectangular and extends laterally (side to side) from one side cut line 42 to an opposite side cut line 42 and front to back from the front fold line 16 to the rear fold line 20. The bottom panel 12 may define a number of slots 88, 90 used for assembly purposed as described below. In the assembled tray 10 the bottom panel 12 may be reinforced with a second bottom layer comprising two partial bottom panels 40, thereby providing a tray bottom having a double thickness along most or all of its load supporting surface.

As noted above, the front panel assembly 14 comprises an outer front panel 28 and an inner front panel 26. As best seen in FIG. 3, the outer front panel 28 is foldably or hingedly connected to the bottom panel 12 along the front fold line 16. In the assembled tray 10 the outer front panel 28 extends upwardly to a front panel top edge 44. The top edge 44 may comprise a single fold line or, preferably, a double fold line as shown in FIG. 3.

The inner front panel 26 may be foldably or hingedly connected to the outer front panel 28 along the double fold line 44 and extends to a front panel free edge 46.

The rear panel assembly 18 comprises the outer rear panel 32 and the inner rear panel 30. The outer rear panel 32 is foldably or hingedly connected to the bottom panel 12 along the rear fold line 20 and, in the assembled tray 10, extends upwardly to a rear panel top edge 50. The rear panel top edge 50 may be defined by a fold line or preferably a double fold line as perhaps best shown in FIG. 3. The outer rear panel 32 is substantially rectangular and extends laterally from one side fold line 74 to the opposite side fold line 74.

The inner rear panel 30 is about the same size and dimensions as the outer rear panel 32. The inner rear panel 30 is hingedly (foldably) connected to the outer rear panel 32 along the rear double fold line 50 and extends from the double fold line 50 to a rear panel free edge 52. The inner rear panel 30 extends laterally from one side cut line 56 to the opposite side cut line 56.

Each inner side panel 22 is foldably connected to an intermediate side panel 36 along a fold line 56 and to an outer side panel 24 along a fold line 58. Each inner side panel 22 extends downward from the fold line 56 to a free bottom edge 60 and front to back from the fold line 58 to a cut line 57.

Each outer side panel 24 is foldably connected to an inner side panel 22 along the fold line 58 and to a top panel 34 along a fold line 62. In the assembled tray 10 each outer side panel 24 extends downward from the fold line 62 to a fold line 64 and front to back from the double fold line 58 to a fold line 66.

Each top panel 34 is foldably connected to an outer side panel 24 along the fold line 62. In the assembled tray 10 each top panel 34 extends laterally inward (toward the other top panel 34) from the fold line 62 to an inner free edge 68 and rearwardly from a front free edge 70 to a rear free edge 72.

Each intermediate side panel 36 is foldably connected to an inner side panel 22 along the fold line 56 and to the outer rear panel 32 by a fold line 74. In the assembled tray 10 each intermediate side panel 36 extends downward from the fold line 56 to an intermediate side panel fold line 76 and front to back from free edge 70 to the fold line 74.

Each rear edge panel 38 is foldably connected to an outer side panel 24 along the fold line 66. In the assembled tray 10 each rear edge panel 38 extends downward from a rear edge tab fold line 78 to a free edge 80 and inwardly from the fold line 66 to a free edge 82.

Each partial bottom panel 40 is foldably connected to an intermediate side panel 36 along the fold line 76. In the assembled tray 10 each partial bottom panel 40 extends inwardly from the fold line 76 to a free edge 84 and rearwardly from a free edge 86 to a side cut line 42. The partial bottom panels 40 provide an additional layer of material to reinforce the tray bottom.

A substantially triangular locking panel 108 is foldably, that is, hingedly, connected to each outer side panel 24 along a fold line 64. The locking panel 108 may be triangular and may have a first free edge 109 that forms a locking panel angle (a) with the fold line 64 as shown in FIGS. 3 and 14.

For assembly purposes, in addition to the main panels described above, the blank 100 may comprise the following additional components and features:

One or more rear panel tabs 54 may extend from the rear panel free edge 52.

The bottom panel 12 may define slots 88 adjacent to the rear fold line 20 and positioned to receive rear panel tabs 54.

One or more front panel tabs 48 may extend from the inner front panel free edge 46.

The bottom panel 12 may define slots 90 adjacent to the front fold line 16 and positioned to receive the front panel tabs 48.

Side panel tabs 94 may extend from the cut line 57 of each inner side panel 22.

The outer rear panel 32 may define vertical slots 92 adjacent to the fold lines 74 and positioned to receive side panel tabs 94.

A preferably hexagonal tab 98 extends from the free edge 80 of each rear edge panel 38.

The outer rear panel 32 may also define slots 96 adjacent to the fold line 20 and positioned to receive hexagonal tabs 98.

A locking tab 104 may extend from an edge 109 of the locking panel 108.

Each intermediate side panel 36 may define a locking opening 102 adjacent to or overlapping the fold line 76.

Each partial bottom panel 40 defines a cutout 105 located along the fold line 76 that communicates with the locking opening 102 in the intermediate side panel 36. The cutout 105 may have the same configuration (shape and size) as the locking tab 104 for the reason explained below.

A top panel tab 35 is foldably connected to each top panel 34 along the free edge 72.

A tab 39 is foldably connected to each rear edge panel 38 along the fold line 78 and defines an opening 106 adjacent to the fold line 78. Each opening 106 is positioned to receive one of the top panel tabs 35.

An elongated tab 110 is foldably connected to each intermediate side panel 36 along a fold line 112 and may be configured to fit between the outer front panel 28 and the inner front panel 26 in the assembled tray 10.

Each partial bottom panel 40 may define a cutout 114 along its rear edge 42 to accommodate a tab 98 in the assembled tray 10.

Tray Assembly

The tray 10 may be assembled in the following manner:

(a) Starting with the flat blank 100 of FIG. 3, fold the partial bottom panels 40 upward 90 degrees along fold lines 76 as indicated by arrow A.

(b) Fold the intermediate panels 36 inward toward each other along fold lines 74 as indicated by arrow B.

Figure 4:
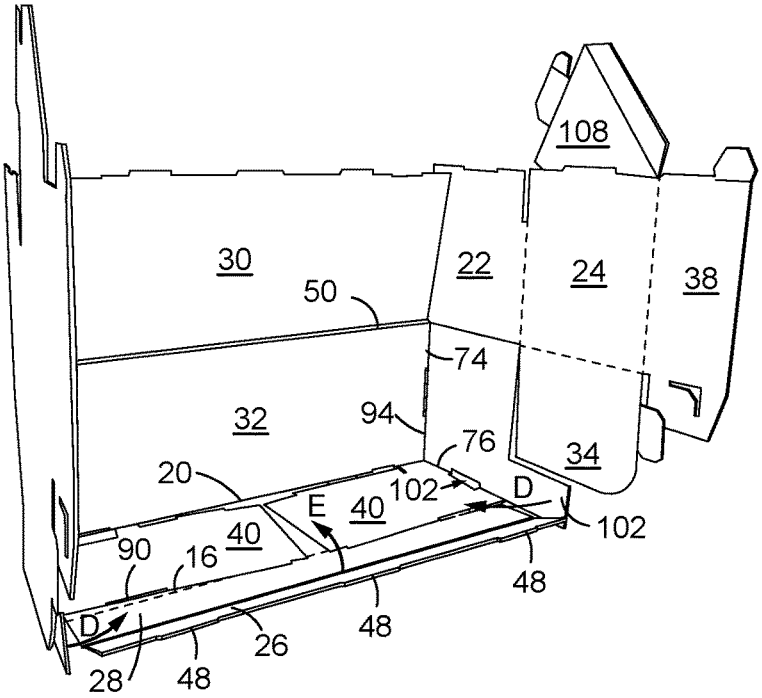
FIGS. 4-11 are perspective views of the tray of FIG. 1 shown in various stages of assembly.

(c) Fold the bottom panel 12 upwards 90 degrees along fold line 16 until the bottom panel 12 abuts the partial bottom panels 40 as indicated by arrow C to achieve the partially folded structure shown in FIG. 4.

(d) Fold the elongated tabs 110 inward 90 degrees toward each other as indicated by arrow D.

(e) Fold the outer front panel 28 upwardly 90 degrees along front fold line 16 as indicated by arrow E.

(f) Fold the inner front panel 26 downward along double fold line 44 until tabs 48 fit into slots 90. The elongated tabs 110 should be captured between the outer front panel 28 and the inner front panel 26. The blank 100 should now look like the partially assembled tray 10 of FIG. 5.

Figure 5:
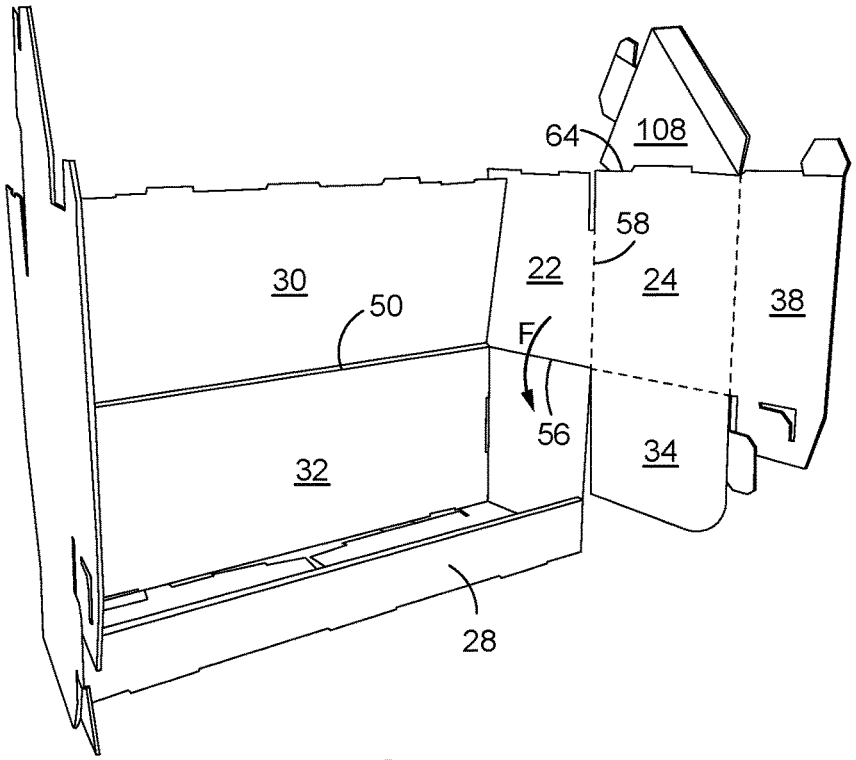
Figure 6:
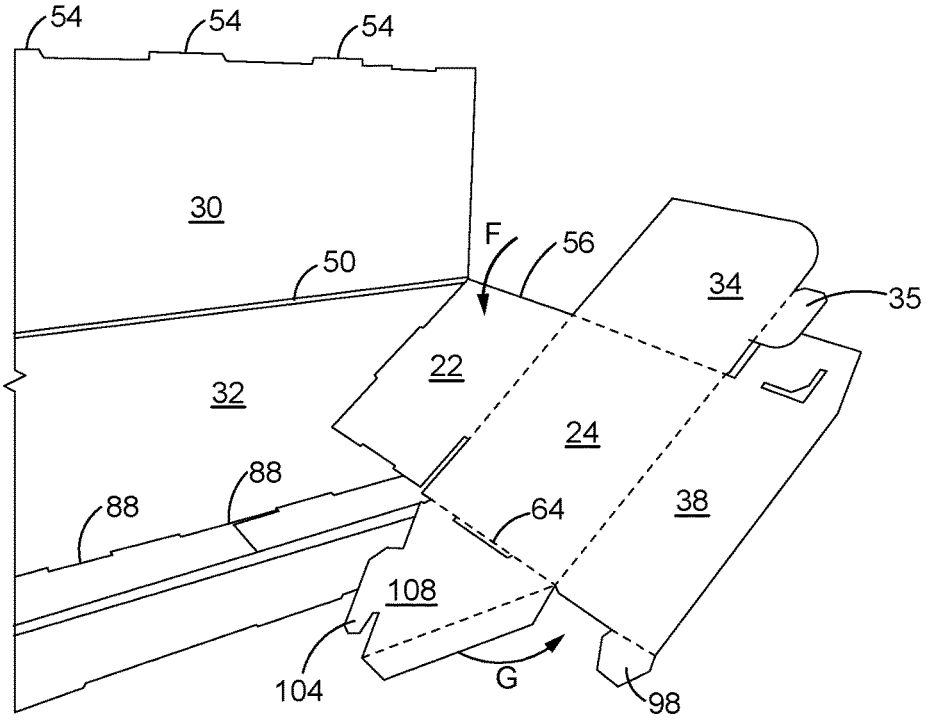

(g) Fold each inner side panel 22 downward along fold line 56 as indicated by arrow F in FIGS. 5 and 6.

Figure 7:
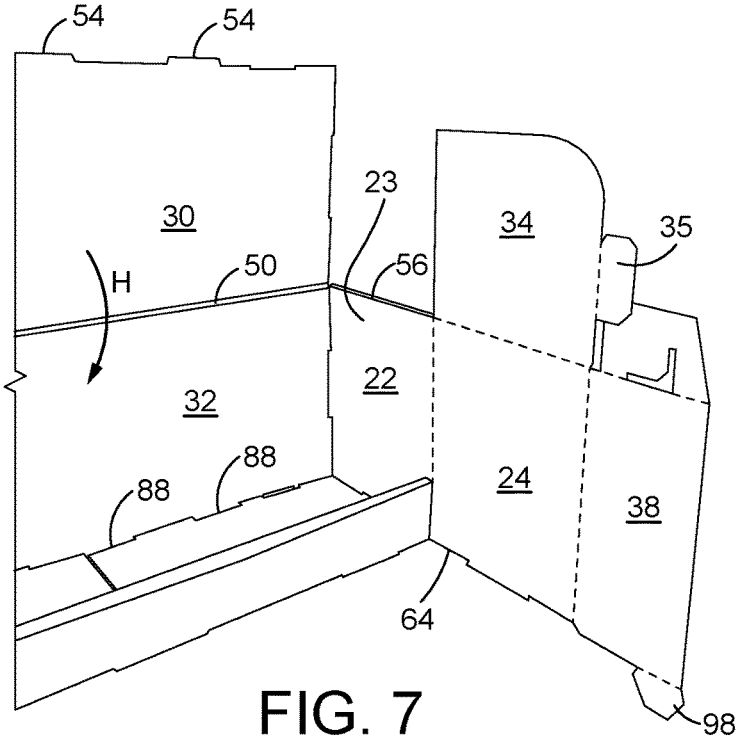

(h) Fold each locking panel 108 outwardly along fold line 64 as indicated by arrow G in FIG. 6. After each inner side panel 22 has been folded downwardly 180 degrees, the structure will look like the partially folded structure shown in FIG. 7.

Figure 8:
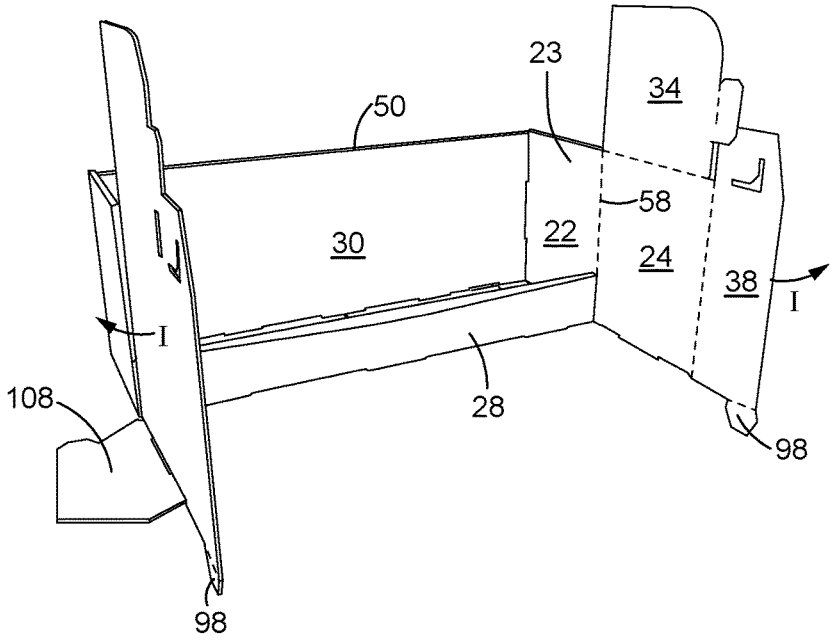

(i) Fold the inner rear panel 30 forward and downward 180 degrees along double fold line 50 as indicated by arrow H and insert tabs 54 into slots 88 to achieve the partially folded structure of FIG. 8.

Figure 9:
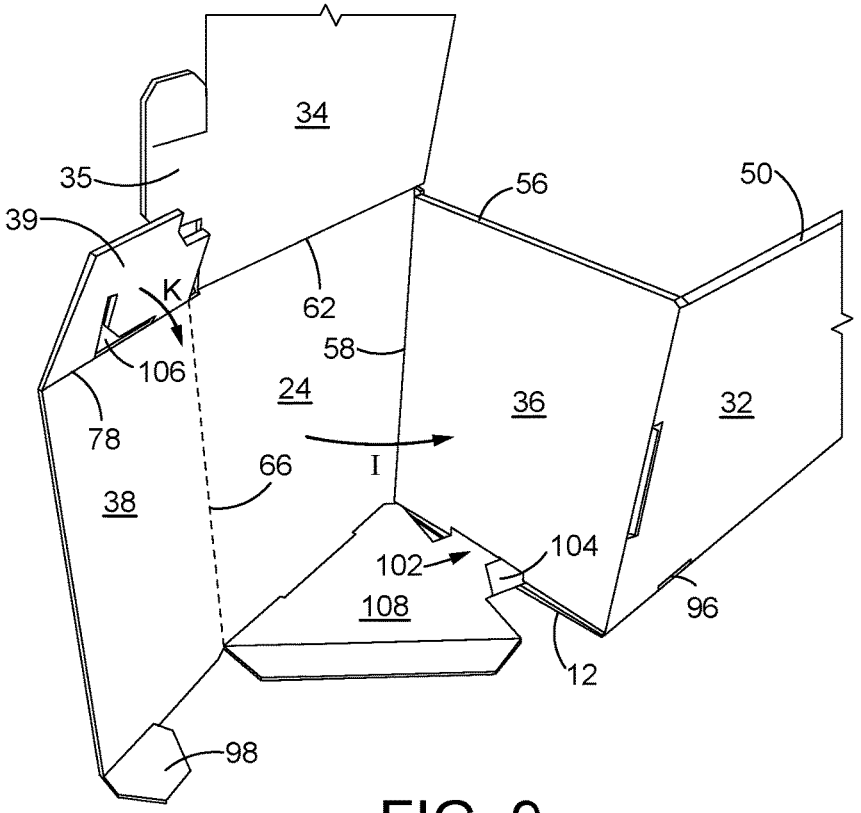

(j) Fold each outer side panel 24 outwardly and rearwardly along fold line 58 as indicated by arrow I in FIGS. 8 and 9. While continuing to rotate each outer side panel 24 along fold line 58, insert the locking tab 104 into locking opening 102. As the outer side panel 24 is further rotated along fold line 58, the locking tab 104 will help guide the locking panel 108 between the partial bottom panel 40 and the bottom panel 12.

Figure 10:
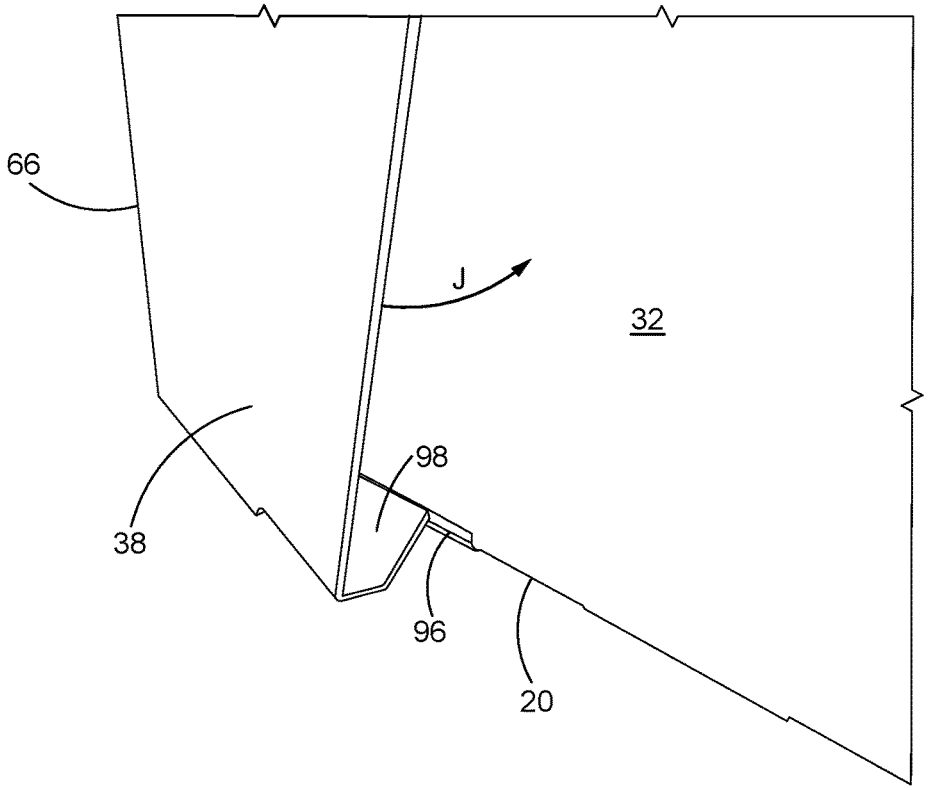

(k) Fold each rear edge panel 38 along fold line 66 as indicated by arrow J in FIG. 10 until the rear edge panel 38 abuts the outer rear panel 32 and tab 98 is inserted into slot 96. Each tab 98 may reside in space created by a cutout 114 in a partial bottom panel 40.

Figure 11:
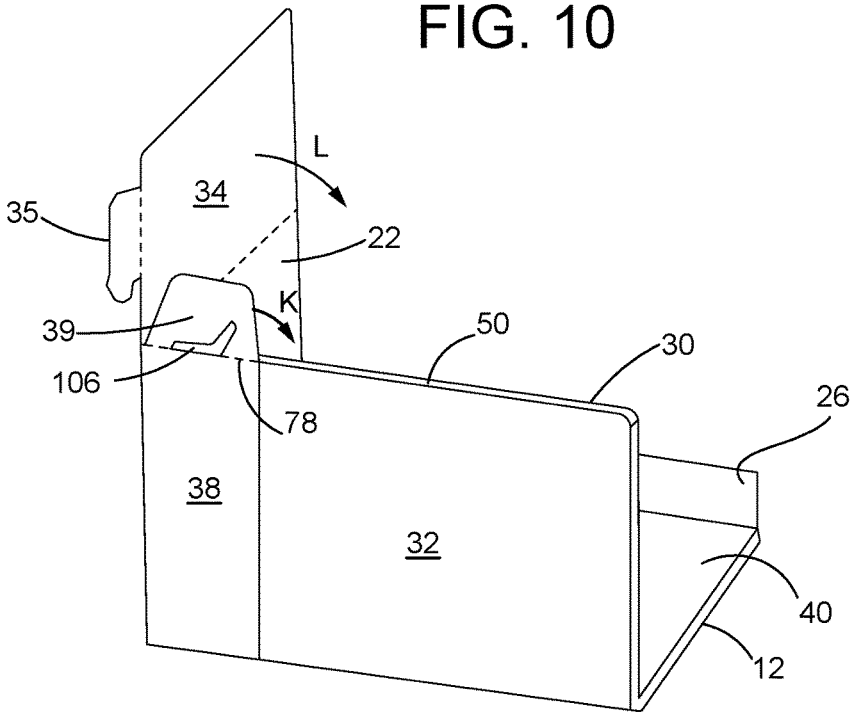

(l) Fold tabs 39 downward 90 degrees as indicated by arrow K in FIG. 11.

(m) Fold each top panel 34 downwardly along fold line 62 as indicated by arrow L in FIG. 11 and insert tab 35 into a corresponding opening 106 along the fold line 78 located between the rear edge panel 38 and the fold tab 39. The tabs 35 may be larger or differently shaped than the openings 106 in order to secure the top panels 34 in the horizontal position. The fully assembled tray 10 is shown in FIGS. 1 and 12.

It should be understood that the method of assembly described above is but one example of how to make the tray 10. More or fewer steps in a same or different order than those described may be included in the method without departing from the scope of the present disclosure.

Tray Expansion

A method of expanding the tray 10 will now be described.

Figure 12:
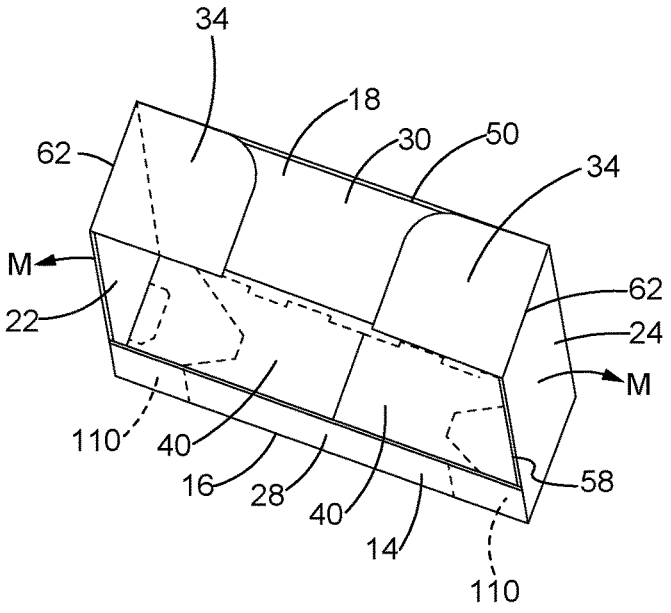
FIG. 12 is a top perspective view of the tray of FIG. 11 after further folding to create a fully assembled tray.

Starting with the tray 10 in its narrowest configuration as shown in FIGS. 1 and 12, pull one or both outer side panels 24 so that they rotate laterally outwardly along fold line 58, away from the inner side panel 22, in the direction shown by arrows M in FIG. 12. Tabs 98 will be withdrawn from slots 88 to release the rear edge panels 38 from their locked position.

As each outer side panel 24 is rotated, the corresponding top panel 34 and locking panel 108 also move laterally outward because they are attached to the outer side panel 24.

Each outer side panel 24 may be rotated until the corresponding locking panel 108 is completely released from between the partial bottom panel 40 and the bottom panel 12 except for the locking tab 104 which resides in the cutout 105.

The locking tab 104 may be lifted upwardly slightly to engage the inner facing surface 23 of the inner side panel 22 to prevent further rotation of the outer side panel 24 and to hold or lock the outer side panel 24 in the expanded position shown in FIG. 2.

In the expanded configuration the outer side panel 24 and the intermediate side panel 36 define an angle of rotation (β) as shown in FIG. 11. The angle of rotation (β) may be greater than 10 degrees and preferably greater than 45 degrees. When the locking tab 104 is inserted into the locking opening 102, the angle of rotation (β) will be the same as the angle (α) defined by the locking panel 108.

One or both outer side panels may be rotated to achieve either a partially expanded tray 10 (with only one side expanded) or the fully expanded tray 10 shown in FIG. 2. In this way the tray 10 can be reconfigured into at least three configurations: (1) narrow or unexpanded (as shown in FIGS. 1 and 12), (2) fully expanded (as shown in FIG. 2), and (3) partially expanded (in which only one side is expanded as shown in FIG. 13).

FIG. 14 is a partial rear perspective view of the tray 10 of FIG. 2 showing the right side expanded. The outer side panel 24 has been rotated outwardly away from the intermediate side panel 36 along the rotation fold line 58. The outer side panel 24 and the intermediate side panel 36 define an angle of rotation (β) which is the same as the locking panel angle (α). In this view it can readily be seen that, after the tray 10 has been expanded on one side, the locking tab 104 extending from the free edge 109 of the locking panel 108 can be inserted into the locking opening 102 to maintain the outer panel 24 in the expanded position.

It should be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A laterally expandable tray made from a unitary blank, the tray comprising:

a bottom panel extending laterally from one side edge to an opposite side edge and rearwardly from a front fold line to a rear fold line;

a front panel assembly hingedly attached to the bottom panel along the front fold line and extending upwardly from the bottom panel;

a rear panel assembly hingedly attached to the bottom panel along a rear fold line and extending upwardly from the bottom panel; and at least one side panel assembly, the side panel assembly comprising an intermediate side panel interposed between an inner side panel and an outer side panel, the intermediate side panel attached orthogonally to the rear panel assembly along a side fold line, the inner side panel attached to the intermediate side panel along a fold line, the outer side panel hingedly attached to the inner side panel along a rotational fold line; wherein the outer side panel is moveable between a first, unexpanded position in which the outer side panel is in a flat, abutting relationship with the intermediate side panel and a second, expanded position in which the outer side panel is connected to the inner side panel along the rotational fold line but rotated outwardly away from the inner side panel and the intermediate side panel to define an angle of rotation (β) with the intermediate side panel.

2. The tray of claim 1 wherein:

the tray comprises two side panel assemblies.

3. The tray of claim 2 further comprising:

a top panel hingedly attached to each outer side panel along a top fold line, the top panel oriented perpendicular to the outer side panel and parallel to the bottom panel.

4. The tray of claim 1 wherein:

the front panel assembly comprises an outer front panel hingedly attached to the bottom panel along a front fold line and an inner front panel attached to the outer front panel along a double fold line and affixed to the bottom panel.

5. The tray of claim 1 wherein:

the bottom panel is reinforced with a second bottom layer comprising two partial bottom panels, each partial bottom panel foldably connected to an intermediate side panel along an intermediate side panel fold line and extending inwardly from the intermediate side panel fold line.

6. The tray of claim 1 wherein:

the rear panel assembly comprises an outer rear panel and an inner rear panel hingedly attached to the outer rear panel along a double fold line and attached to the bottom panel.

7. The tray of claim 5 further comprising:

a locking panel hingedly connected to the outer side panel along a locking panel fold line, the locking panel having a first free edge that forms a locking panel angle ($\alpha$) with the locking panel fold line, the locking panel configured to fit between the partial bottom panel and the bottom panel when the tray is in the first, unexpanded position.

8. The tray of claim 7 wherein:

the intermediate side panel defines a locking opening; and the tray further comprises a locking tab extending from the free edge of the locking panel, the locking tab configured to fit into the locking opening to lock the outer side panel in place when the outer side panel is in the second, expanded position.

9. The tray of claim 7 wherein:

the angle of rotation ($\beta$) is the same as the locking panel angle ($\alpha$).

10. The tray of claim 1 further comprising:

two rear edge panels, each rear edge panel connected to an outer side panel along a fold line.

11. The tray of claim 10 further comprising:

a tab foldably connected to each top panel along a top panel free edge; and a tab foldably connected to each rear edge panel along a rear edge tab fold line, each rear edge panel tab defining an opening adjacent to the rear edge tab fold line, each opening being positioned to receive one of the top panel tabs when the tray is in the first, unexpended position.

12. The tray of claim 10 further comprising:

a tab extending from a free edge of each rear edge panel, each tab configured to fit into a corresponding slot when the tray is in the first, unexpended position, the slots defined by the outer rear panel.

13. A blank for making a laterally expandable tray, the blank comprising:

a bottom panel extending laterally from a side cut line to an opposite side cut line and rearwardly from a front fold line to a rear fold line;

an outer front panel connected to the bottom panel along the front fold line;

an inner front panel connected to the outer front panel along a double fold line;

an outer rear panel connected to the bottom panel along the rear fold line, the outer rear panel extending laterally from a side fold line to an opposite side fold line;

an inner rear panel connected to the outer rear panel along a rear double fold line, the inner rear panel extending laterally from a side cut line to an opposite side cut line;

two intermediate side panels, each intermediate side panel connected to the outer rear panel by a fold line;

two inner side panels, each inner side panel connected to one of the two intermediate side panels along a fold line;

two outer side panels, each outer side panel connected to one of the two inner side panels along a fold line; and two top panels, each top panel connected to one of the two outer side panels along a fold line.

14. The blank of claim 13 further comprising:

two rear edge panels, each rear edge panel connected to one of the two outer side panels along a fold line.

15. The blank of claim 13 further comprising:

two partial bottom panels, each partial bottom panel connected to one of the two intermediate side panels along a fold line.

16. The blank of claim 13 further comprising:

two substantially triangular locking panels, each locking panel connected to one of the two outer side panels along a fold line.

* * * * *